US005136745A

United States Patent [19]

Davies et al.

[11] Patent Number: 5,136,745

[45] Date of Patent: Aug. 11, 1992

[54] SHOE SUPPORT

[75] Inventors: John Davies, Syston; Terence J. Brown, Wigston, both of England

[73] Assignee: British United Shoe Machinery Ltd., Leicester, England

[21] Appl. No.: 555,170

[22] Filed: Jul. 18, 1990

[30] Foreign Application Priority Data

Aug. 7, 1989 [GB] United Kingdom ..... 8918037

[51] Int. Cl.[5] ..... A43D 21/00

[52] U.S. Cl. ..... 12/14.2; 12/123

[58] Field of Search ..... 12/14.2, 14.3, 123, 12/125, 126, 77, 127; 69/6.5

[56] References Cited

U.S. PATENT DOCUMENTS

| | | | |
|---|---|---|---|
| 206,203 | 7/1878 | Wheeler et al. | 12/14.3 X |
| 268,019 | 11/1882 | Hodgdon | 12/14.3 |
| 452,146 | 5/1891 | Hagle | 12/14.3 |
| 558,026 | 4/1896 | Barrett | 12/14.3 |
| 1,222,126 | 4/1917 | Perri | 12/14.2 X |
| 1,884,508 | 10/1932 | Bagshaw | 12/14.3 |
| 2,221,864 | 11/1940 | Cummings | 12/14.2 X |
| 3,645,118 | 2/1972 | Babson | 69/6.5 |
| 3,671,989 | 6/1972 | Deryck | 12/123 |
| 3,704,604 | 12/1972 | Boot et al. | 69/6.5 |
| 3,843,985 | 10/1974 | Leonhardt | 12/77 X |
| 3,975,932 | 8/1976 | Vornberger | 69/6.5 |
| 4,000,535 | 1/1977 | Barton | 12/126 |
| 4,020,660 | 3/1977 | Bergeron | 12/77 X |
| 4,391,011 | 7/1983 | Peck et al. | 12/1 B |
| 4,400,839 | 8/1983 | Hartshorn et al. | 12/12.5 |
| 4,404,700 | 9/1983 | Berrill et al. | 12/127 X |
| 4,404,701 | 9/1983 | Hartshorn et al. | 12/127 |
| 4,416,031 | 11/1983 | Shutt et al. | 12/127 |
| 4,691,398 | 9/1987 | Kadogawa et al. | 12/77 |
| 4,709,434 | 12/1987 | Bis et al. | 12/77 |
| 4,951,338 | 8/1990 | Brown et al. | 69/6.5 X |
| 4,970,745 | 11/1990 | Davies | 12/77 |

*Primary Examiner*—Paul T. Sewell
*Assistant Examiner*—Ted Kavanaugh

[57] ABSTRACT

A shoe support (18') for use e.g. in a machine for operating progressively on side wall portions of a lasted shoe upper comprises a last pin (722') and a toe support (792) both of which are movable heightwise to bring a shoe supported thereby to a heel seat height datum and toe end height datum as determined respectively by a toe abutment (806) and a holddown (450') which engages the insole in the heel seat region of the shoe. Heel end centralising means (390) and toe end centralising means (822') are also provided. More particularly toe centralising fingers (822') are provided with collars (882) mounted for equidistant heightwise movement to engage the lasting marginal portions of the shoe in the forepart region and thus level the shoe bottom about the heel-to-toe line determined by the holddown and toe abutment. In addition the last pin can rock about a lengthwise axis and is locked in "rocked" position by a wedging system (862, 866). When the shoe has been properly located the last pin is urged to pivot toewardly thus to cause the last pin to "bind" on the last pin hole formed in the last and, by the counter-force supplied by the toe support (792), the shoe is thus securely clamped on the last pin and toe support.

14 Claims, 5 Drawing Sheets

SHOE SUPPORT

BACKGROUND OF THE INVENTION

This invention is concerned with a shoe support for supporting a lasted shoe comprising a last pin and a toe support by which respectively the heel and toe ends of a lasted shoe can be supported, the last pin being mounted on a last pin support for limited tilting movement about an axis extending lengthwise of a shoe supported as aforesaid.

Shoe supports of the aforementioned type but for use in the lasting of shoes (as opposed to for supporting lasted shoes) are well known: see e.g. U.S.-A4,4400,839, in which a shoe support is described for use in a heel seat lasting machine. It will of course be appreciated that the tilting facility for the last pin in this latter machine is to enable the heel seat of the shoe to accommodate to the plane of the wiper plates of the machine as said plates effect an inwiping movement over the heel seat of the shoe and to enable bedding pressure to be applied over the whole of the inwiped area; that is to say, the tilting movement allows the shoe to accommodate to the wiper plates during the machine operation.

In operating upon lasted shoes it is sometimes the case that the shoe has to be set in a particular orientation and at a particular height datum before the operation can take place. By way of example, in a side wall roughing operation control of the extent of the area which is roughed is critical, since if the area of rough is too large the appearance of the finished shoe will be unsightly, while if said area is insufficiently large inadequate bonding of the side wall of a sole unit to the side wall of the upper will result. Thus, where it is a question of an automatic side wall roughing machine, it will be appreciated, not only the heightwise setting of the shoe to general height datum positions at the toe and heel ends thereof but also accurate positioning of the side wall portions about the heel-to-toe line of the shoe are a pre-requisite to acceptable roughing. This is, moreover, especially the case where the automatic roughing is carried out under computer control using programmed instructions based upon the "style teaching" from a single model shoe and reliance is placed upon grading and data inversion for handling shoes of the same style but different sizes and opposite hand. One shoe support for use in such a machine is described in our U.S. Ser. No. 377,234 now U.S. Pat. No. 4,970,745, which shoe support relies upon a combination of a holddown, which extends across the width of the shoe in the heel seat region thereof, and a last pin which is mounted for limited pivotal movement about an axis extending lengthwise of the shoe supported as aforesaid, thus to enable the shoe bottom to be levelled appropriately to the holddown with a view to bringing successive shoes to a pre-determined position in relation to the roughing tool of the machine of which the shoe support forms part.

It will of course be appreciated that the lasting margin in the heel seat region of a lasted shoe is uneven because of the number of pleats formed in said margin in the heel seat lasting operation. As a consequence, it has been found that placing reliance upon levelling the shoe by engagement of the holddown with the lasting margin in the heel seat region does not necessarily lead to an acceptable result in all cases even so far as concerns the heel end of the shoe, and still less is this the case for the forepart region, which, it will be appreciated, is often the more important region from the point of view of the appearance of the finished shoe.

OBJECT OF THE INVENTION

It is thus the object of the present invention to provide an improved shoe support for supporting a lasted shoe wherein the shoe bottom, especially in the forepart region, is more accurately levelled in readiness for e.g. a side wall roughing operation, than has previously been the case.

SUMMARY OF THE INVENTION

The invention thus provides, in one of its several aspects, a shoe support for supporting a lasted shoe comprising a last pin and a toe support by which respectively the heel and toe ends of a lasted shoe can be supported, the last pin being mounted on a last pin support for limited tilting movement about an axis extending lengthwise of a shoe supported as aforesaid, two shoe-engaging members arranged, in a fixed heightwise relationship with one another, one at each side of the lasted shoe supported by the toe support and last pin so as to be engageable with the lasting margin of such shoe in the forepart region thereof, and means for effecting relative movement of approach, heightwise of the shoe bottom, between the toe support and the shoe-engaging members whereby a lasted shoe supported as aforesaid can be positioned with the lasting margins at opposite sides thereof at a location determined by the shoe-engaging members.

It will be appreciated that in the forepart region of the bottom of a lasted shoe, although the lasting margin has been secured to the insole it will generally be the case that the lasting margin is flat, partly because of the ironing effect of the wiper plates, but also because, in the absence of any sharp contours in the shoe bottom edge, pleating of the upper material in the lasting margin is unlikely to arise. Thus, in using a shoe support in accordance with the invention the forepart of the shoe bottom is now directly located heightwise along its margins, with consequent enhanced accuracy and reliability, so that e.g. a side wall roughing operation can be effected on the thus located shoe with a greater degree of control over the extent of the area of rough.

The shoe support in accordance with the invention also preferably comprises a heel seat abutment which is dimensionable so as to be engageable with the insole of a shoe supported as aforesaid in the heel seat region thereof, and means for effecting relative movement of approach, heightwise of the shoe bottom, between said heel seat abutment and the last pin whereby the heel seat of such shoe is brought to a heel seat height datum. It will of course be appreciated that by so dimensioning the heel seat abutment as to be engageable with the insole rather than with the pleated lasting marginal portion of the heel seat of the shoe bottom, a more reliable height setting for the heel seat is achieved. Moreover, by this arrangement reliance is no longer placed upon the heel seat abutment to level the shoe bottom as a whole, but rather said abutment merely provides a third point, in cooperation with the two shoe-engaging members engaging in the forepart region of the shoe, to provide for the levelling of the shoe bottom. The provision of a heel seat height datum by the heel seat abutment of course ensures that successive shoes supported by the shoe support are consistently supported with their side wall regions at a desired heightwise position in relation to a side wall roughing tool of the machine of which the shoe support forms part.

In addition, the shoe support in accordance with the invention may also provide a toe abutment which is engageable with the lasting margin of the toe end of a lasted shoe supported as aforesaid at the toe region thereof, and means for effecting relative movement of approach, heightwise of the shoe bottom, between the toe abutment and the toe support whereby the toe end of such shoe is brought to a toe height datum. Apart from providing a toe height datum, it will be appreciated that the heel seat abutment and the toe abutment thus engage the shoe along a heel-to-toe line and the two shoe-engaging members engageable with the lasting margins as aforesaid then serve merely to level the shoe about that heel-to-toe line. In an alternative embodiment of the invention, on the other hand, the two shoe-engaging members may themselves serve the function of the toe abutment and thus serve to position the toe end of the shoe at a desired toe height datum.

Relative heightwise movement of approach is preferably effected between the two shoe-engaging members and the toe support to bring said members into engagement with the lasting margins of the shoe only after each of the heel seat and toe ends of the shoe has been brought their respective height datum positioned as aforesaid. More particularly, preferably firstly the heel seat abutment is movable into and out of an operative position in which it is disposed in opposed relationship with the last pin and the means for effecting relative movement of approach between the heel seat abutment and the last pin is effective to move the last pin towards the abutment, while the toe abutment is movable into and out of an operative position in which it can co-operate with the toe support and the means for effecting relative movement of approach between the toe support and the toe abutment is effective to move the toe support towards the toe abutment, and the means for effecting relative movement between the toe support and the two shoe-engaging members is also effective to move said members towards the toe support. It will thus be appreciated that the toe and heel ends of the shoe are first brought to their respective height datum positions and thereafter the shoe-engaging members operate to level the shoe bottom.

The shoe support referred to in the third paragraph of this specification comprises toe centralising means engageable with opposite sides of a shoe supported as aforesaid in the forepart region thereof, said means including two centralising elements arranged one at either side of such shoe and movable equidistantly but in contrary directions transversely of the shoe bottom. Such centralising elements are also provided in the shoe support of the present invention in this case, moreover, convenienctly each such element supports one of said two shoe-engaging members. In this way, the toe centralising elements can provide two functions, namely centralising and levelling, while providing a compact mechanism for achieving these two functions.

As has already been mentioned, the last pin is mounted for limited tilting movement transversely of the shoe bottom, i.e. about an axis extending lengthwise of the shoe bottom. By providing for such tilting movement the shoe bottom can more readily be levelled as above described. In order, once the last pin has been tilted appropriately according to the contour of the shoe bottom, to ensure that the position of the shoe is maintained during the subsequent operation to be performed thereon, and bearing in mind that the two shoe-engaging members have to be retracted for any marginal operation to be performed upon the shoe, the shoe support preferably also comprises locking means for locking the last pin against tilting movement after the shoe has been positioned as determined by the two shoe-engaging members, said locking means comprising a first wedge element fixedly connected with the last pin and a second, complementary, wedge element slidably mounted on the last pin support, the arrangement being such that after the positioning of the shoe as aforesaid the second wedge element is caused to slide on the last pin support and thus to engage and lock the first wedge element and the last pin therewith. Conveniently, furthermore, the first wedge element is constituted by a segment of a disc having a chamfered edge whereby with the centre of the disc located at the tilt axis of the last pin the portion of the edge presented for cooperation with the second wedge element has the same shape regardless of the position to which the last pin has been tilted. In this way, regardless of the degree of tilt of the last pin (within the pre-set limitations), the wedging action of the two wedge elements will remain effective to hold the last pin in its tilted condition.

It will be appreciated that the shoe support in accordance with the present invention is especially, but not exclusively, suitable for use in a machine for operating progressively along side wall portions of a lasted shoe upper, e.g. a machine for effecting a roughing operation along side wall portions of such a shoe upper.

BRIEF DESCRIPTION OF THE DRAWINGS

There now follows a detailed description, to be read with reference to the accompanying drawings, of a shoe support in accordance with the invention and forming part of a machine for operating progressively along side wall portions of a lasted shoe upper, this shoe support and machine having been selected for description merely by way of non-limiting example.

In the accompanying drawings.

DESCRIPTION OF THE PREFERRED EMBODIMENT

Figure 1:
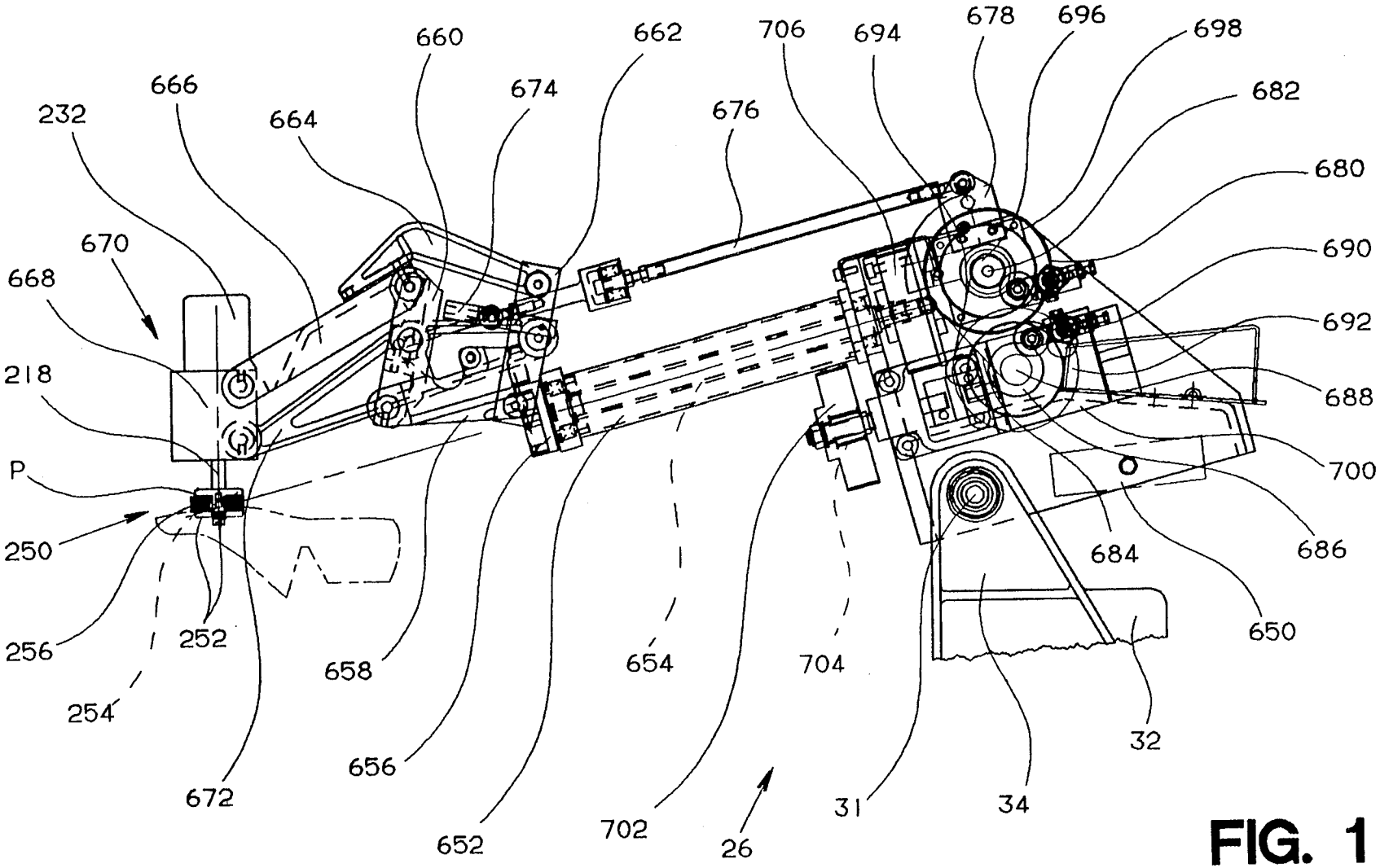
FIG. 1 is a view in side elevation of a tool support arrangement of the machine in accordance with the invention, with a tool supported thereby.

The machine now to be described is generally similar, except as hereinafter described, to the machine described in EP-A0091321 (corresponding, U.S. Pat. application Ser. No. 303,045) now U.S. Pat. No. 4,959,977, itself a modification of the apparatus described in U.S. Specification No. 4391011, which machine is for performing a roughing operation progressively along marginal portions of a shoe bottom. It will however be appreciated that the machine described hereinafter is a machine for performing a roughing operation progressively along side wall portions of a shoe. Reliance is thus placed upon the disclosure of the aforementioned U.S. specification and in particular, where like parts are incorporated in the two machines but are not shown in the drawings of the present specification, the reference numerals from the earlier specification are used, but are placed in brackets to indicate that the parts are not shown in the present drawings.

The machine in accordance with the invention thus comprises a base (10) supporting, by a bracket (12), a pivot shaft 14 about which a support 16 for a shoe support 18' can pivot. The shoe support, details of which are set out hereinafter, is arranged to support a shoe S bottom uppermost, with the toe end thereof facing towards the front of the machine, i.e. towards the operator.

At its rear, the base (10) supports a support column structure (22) carrying a casting (24) on which is supported, for pivotal movement about a vertical axis, a support casting 34 having two upstanding lugs 32 between which tool supporting means generally designated 26' is supported for pivotal movement about a horizontal axis 31.

The machine further comprises a first stepping motor (144) mounted on the base (10) and effective to cause pivotal movement of the shoe support 18' to take place about the horizontal axis provided by the shaft 14 (X-axis movement). Similarly, a second stepping motor (84) is provided, carried by the casting (24) and effective to cause pivotal movement of the support casting 34 about its vertical axis (Y-axis movement). In addition, a third stepping motor (122—described in U.S. 4,391,011) is supported by the support casting 34, rearwardly of its vertical pivot, to cause it, and thus the tool supporting means 26' supported thereby, to pivot about its horizontal axis 31 (Z-axis movement). It will be appreciated that the X-, Y- and Z-axes represent three coordinate axes along which a tool supported by the tool supporting means 26' can move.

Further details of the construction by which movement along the three axes can take place can be found in EP-A0091321 and also in U.S. 4,391,011.

The tool supporting means 26' of the machine in accordance with the invention comprises a housing 650 mounted for pivotal movement about said horizontal axis 31. From a forward face of the housing projects a hollow tubular arm 652 within which is accommodated, for rotational movement therein, a support rod 654. At the forward end of said rod is a plate 656 supporting two forwardly projecting arms 658, which are spaced apart widthwise of the machine and on each of which is mounted, for pivotal movement, a pair of links 660, 662, upper ends of which pivotally support a plate 664. The links 660, 662, together with the plate 664 and arms 658, thus comprise a first parallel linkage arrangement of the tool supporting means.

Fixedly secured to a forward end of the plate 664, and projecting forwardly therefrom, is a further plate 666, in a forward, bifurcated, end of which is pivotally mounted a block 668 forming part of a tool holder generally designated 670. Also secured to the tool holder, at the left-hand side thereof, is a further link 672 which is in turn pivotally connected to each of the left-hand links 660, 662. The links 660, 662, tool holder 670, link 672 and composite plate 664, 666 thus constitute a second parallel linkage of the tool supporting means. The various pivots are so arranged in relation to one another that the tool holder is caused to pivot about an axis (a virtual centre) which passes through a point P, through which point also passes the axis of the support rod 654. As will be described hereinafter, furthermore, when a tool is supported in the tool holder 670, the axis of rotation thereof also passes through said point P. The point P represents a height datum of the machine in a desired relationship with which the bottom of a shoe supported by the shoe support 18' can be positioned by means of a holddown member 450 and toe support means 470' of said support. Furthermore, the point P lies vertically above the axis 14 of the shoe support 18'.

For effecting such pivotal, or tilting, movement of the tool holder 670 about the transverse axis, the links 662 carry therebetween a block 674 to which is pivotally connected a forward end of a push-rod 676, the rearward end of which is similarly pivotally connected to a block 678 which is mounted on a pulley 680 freely rotatable about a drive shaft 682. The pulley 680 is caused to rotate about said shaft by a timing belt 684 entrained around a second pulley 688, a tensioning pulley 690 being provided for maintaining the tension in the belt. Also mounted on the shaft 688 is a third pulley 692 around which is entrained a second timing belt 694 meshing with a fourth, drive, pulley 696 secured on the drive shaft 682. The shaft 682 is driven by a stepping motor 698.

For effecting rotational movement of the support rod 654, a similar drive arrangement is provided comprising a stepping motor 700 acting through pulleys 702, 704, 706 (the fourth not being shown) and timing belts (not shown), the pulley 706 being fixedly mounted on the support rod 654.

Figure 2:
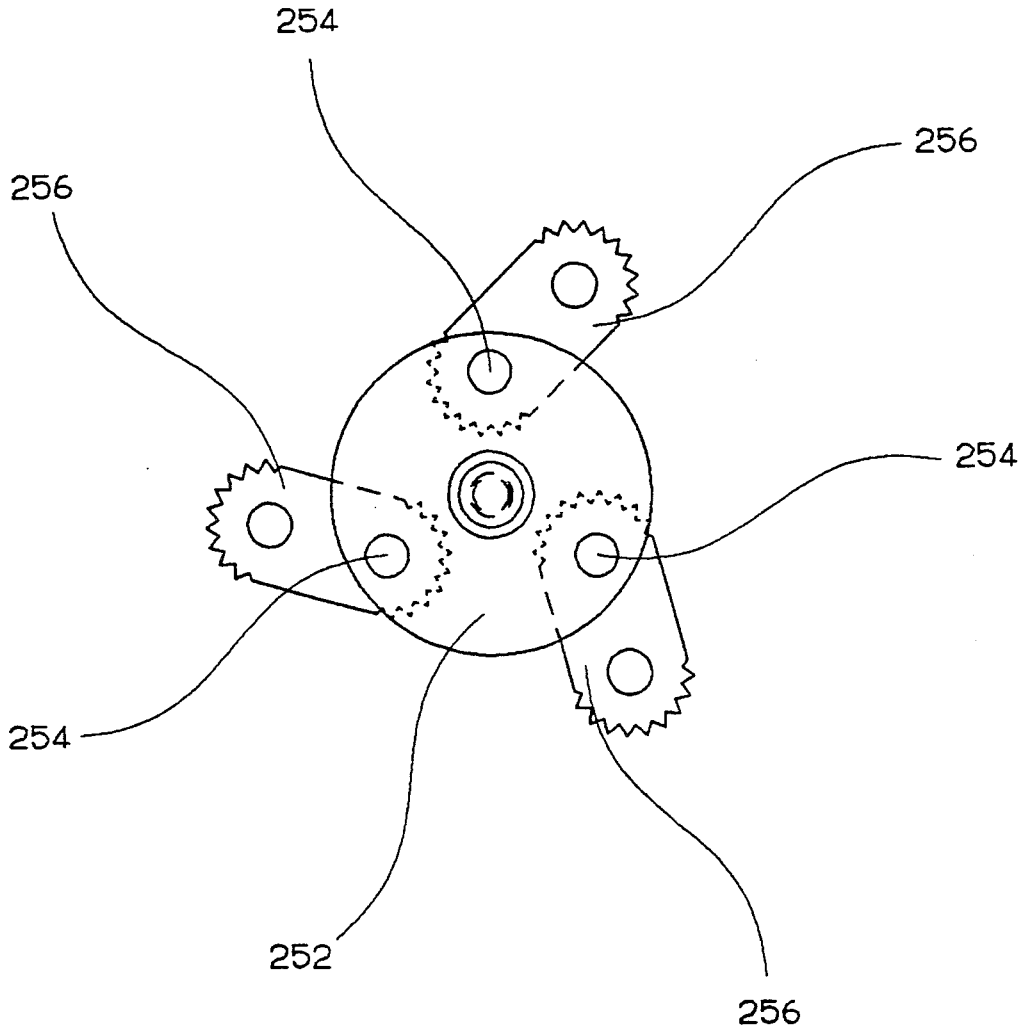
FIG. 2 is a view of a roughing tool having flail-like roughing devices.

The tool holder 670 is arranged to support a tool-supporting shaft 218 which is caused to rotate by means of a reversible motor 232, itself mounted on the tool holder 670 and being operatively connected to the shaft 218 via a belt-and-pulley connection (not shown). The lower end of the shaft 218 is adapted to receive a suitable roughing tool generally designated 250. Whereas this tool may be any suitable roughing tool, e.g. a radial wire brush or an abrasive-covered wheel, in the emodiment shown in the drawings the tool comprises two discs 252 spaced apart from one another by three pins 254, each pin supporting a plurality of thin plate-like roughing elements 256. As is clearly seen in FIG. 2, each plate-like element 256 is loosely mounted on its pin for pivotal movement thereon, is generally oval in shape and comprises, at each semi-circular end a plurality of teeth, the teeth providing a roughing surface of the tool. When the tool is caused to rotate, the various plate-like elements are urged outwardly about the pins 252, by virtue of centrifugal force, in a flail-like action. It will of course be appreciated that, since a plurality of such elements is provided on each pin, the amount to which each element is thrown outwardly by centrifugal force will be determined to some degree by the contour of the shoe which is engaged thereby, each set of such elements thus together forming a shape, upon engagement with the shoe, complementary to the contour of the portion of the side wall of the shoe being roughed thereby. It will also be appreciated that, using a tool as described above, any irregularites in the side wall portion of the shoe being operated upon may be compensated for by the action of the elements 256.

Figure 3:
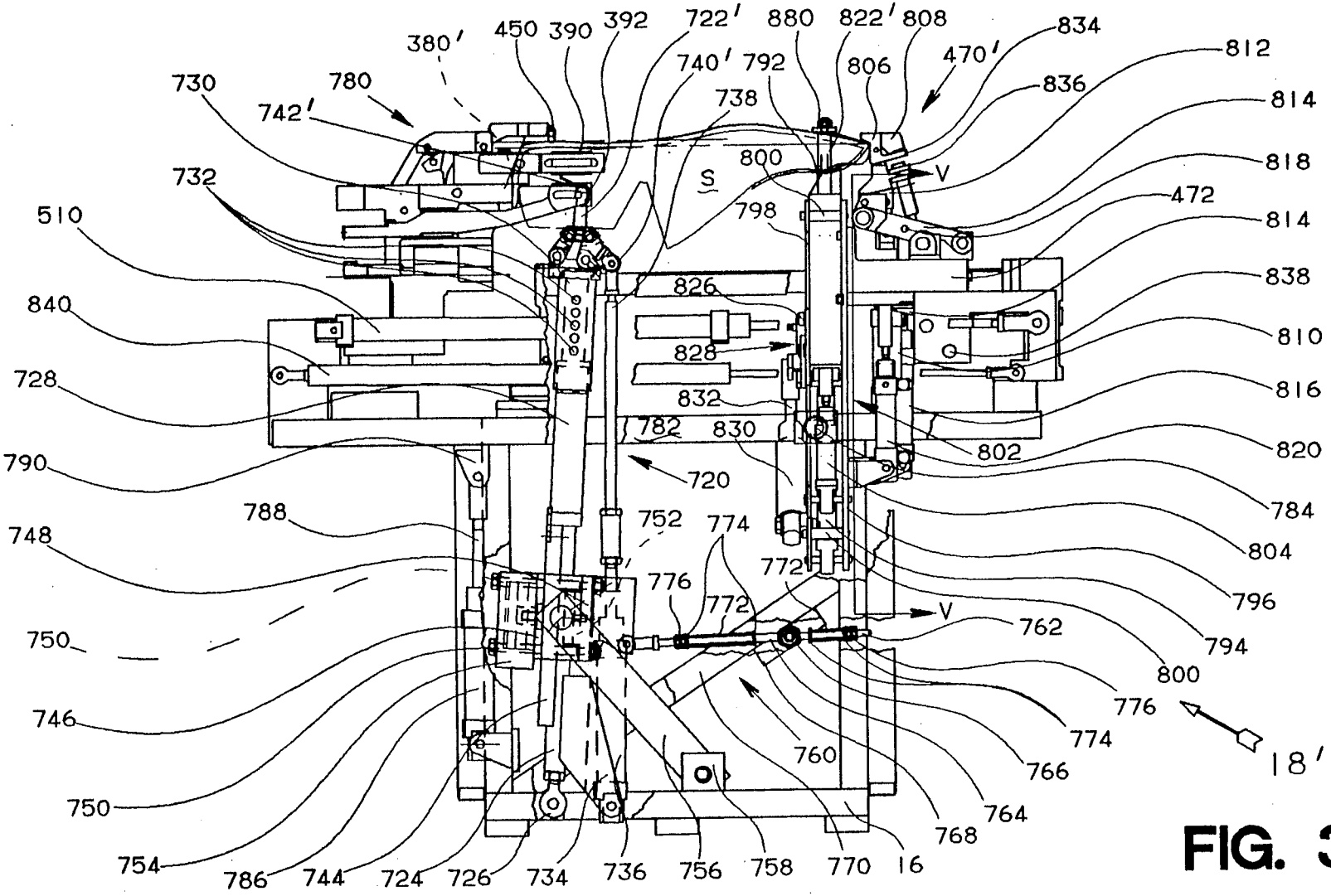
FIG. 3 is a view in side elevation of a shoe support in accordance with the invention.

Referring now to FIG. 3, the shoe support 18' in accordance with the invention (which is generally similar, except as hereinafter described, to the shoe support described in our co-pending U.S. Pat. application Ser. No. 377,234) now U.S. Pat. No. 4,970,745, comprises a support 720 for a last pin 722', said support itself comprising a rod 724, mounted at its lower end, by a spherical mounting 726, on the support 16 of the shoe support and extending upwardly, together with a sleeve 728 which is slidable on the rod 724 and carries at its upper end a mounting 730 for the last pin 722'. The position of the sleeve 728 relative to the rod 724 can be set by selectively inserting a pin (not shown) in one of a number of apertures 732, the pin being arranged to rest in engagement with the top end of the rod 724.

For effecting heightwise movement of the support 720 a forked member 734 is secured towards the lower end of the rod 724 and in turn supports, between its forks, a piston-and-cylinder arrangement 736, the piston rod 738 of which extends upwardly and is connected at its upper end by a universal joint to a bifurcated projection 740' formed on a block made up of two links 850 (FIG. 4) fixedly connected together by a cross-strap and pivotally mounted on a plate 852'. Also pivotally mounted on said plate 852' is a further block also made up of two links 854 connected by a cross-strap, each of the links 850, 854 also being pivotally connected to a carrier block 856 in which the last pin 722' is secured. The links 850, 854 thus constitute a four-bar linkage arrangement on which the last pin is mounted and which is effective, in response to actuation of the piston-and-cylinder arrangement 736 to cause the last pin to pivot, over a range of movement including the vertical position of the last pin, about a notional axis 742' which lies at or adjacent the tip of the last pin.

The mounting 730 for the last pin 722' also comprises a pivot pin 858 by means of which the plate 852' is mounted at the upper end of the sleeve 728, the arrangement being such that the last pin 722' can thus pivot (or rock) about said pin, in a direction extending transversely of the shoe bottom, about the axis of the pin, which extends in a direction generally lengthwise of the shoe bottom. For holding the last pin in the position to which it is thus rocked, furthermore, the plate 852' is provided with depending elongated extensions 860 which are generally in the form of segments of a circle the centre of curvature of which is coincident with the axis of the pin 858. Moreover, the lower end of each extension 860 is chamfered, thus to provide a wedge element 862. Cooperating with the wedge elements 862 is a sleeve 864 which is mounted on the sleeve 728 for sliding movement relative thereto, the sleeve 864 having an upper end providing two internal flatted surfaces and thus constituting two wedge portions 866 which cooperate with the wedge elements 862 associated with the extensions 860. Thus, by moving the sleeve upwardly relative to the last pin, the wedging elements and portions 862, 866 cooperate to lock the last pin in a position to which it has been rocked about the axis of the pin, that is to say transversely of the shoe bottom. It will of course be appreciated that because of the segment-like construction of the wedge elements, the wedging action takes place in a consistent matter regardless of the position to which the pin has been rocked.

For moving the sleeve 864 heightwise, a piston-and-cylinder arrangement 868 is provided, comprising a piston portion which is secured to the sleeve 728, relative to which the cylinder can move heightwise, the sleeve being secured to the cylinder by links 870.

The mounting 730'' for the last pin 722' further comprises means for centralising the last pin about the axis of the pivot pin 858', said means comprising a spring-urged ball 872 which, in a centralised position of the last pin, engages in a detent 874 provided at the upper end of the sleeve 728, the arrangement being such that when the last pin is rocked the ball 872 is caused to move partially from the detent 874, but the spring is effective to urge the ball to recover its position of being fully accommodated in the detent, thereby effecting a centralising movement of the pin. The clamping action of the wedge elements and portions 862, 866 is of course sufficient to hold the ball out of the detent and thus hold the last pin in its rocked position.

At its lower end the sleeve 728 carries a semi-cylindrical member 744 which extends around the lower end of the rod 724. The member 744 and rod 724 pass between two clamp plates 746, 748 which are held spaced apart on four rods 750 (two only shown in FIG. 3). The plate 748 also supports, for limited sliding movement in a direction extending transversely of the bottom of a shoe supported by the last pin, a further semi-cylindrical member 752 which fits about the opposite side of the rod 724 from that contacted by the member 744. For moving the clamp plates towards one another a short-stroke piston-and-cylinder arrangement 754 is provided, whereby the members 744, 752 are urged against the rod to clamp it in any position to which it has been moved, both heightwise and widthwise, in the loading of a shoe, as will be explained hereinafter.

The assembly of clamp plates 746, 748 and the piston-and-cylinder arrangement 754 is pivotally supported by two links 756 which are carried on blocks 758 in turn carried on the support 16 for the shoe support. Said assembly can thus pivot to a limited degree, in a direction extending lengthwise of the bottom of a shoe supported by the last pin, as the loading of the shoe is taking place.

For establishing an initial position for the last pin 722', a balancing arrangement generally designated 760 is provided, comprising a rod 762 pivotally mounted at one end on the cylinder 736 and having a central portion 764 of enlarged diameter accommodated in a block 766 itself carried in blocks 768 secured to strut members 770 forming part of the support 16. At each side of said portions 764 the rod 762 carries a compression spring 772, washers 774 being provided at opposite ends of the springs for abutment against surfaces provided either by the portion 764 or by lock nuts 776 threadedly secured to the rod. The effect of the springs 772 is thus to centralise the rod in relation to the block 766, thus to establish the initial position of the last pin support, while nevertheless allowing it to move in any direction on the spherical mounting 726.

The shoe support in accordance with the invention also comprises a combined holddown and heel end centralising assembly generally designated 780. This assembly is mounted on a frame 782 which is supported for pivotal movement about an axis 784 on the support 16. For effecting such pivotal movement two piston-and-cylinder arrangements 786 (one only shown in FIG. 3) are carried by the support 16 and the piston rod 788 of each such arrangement is pivotally connected with a lug 790 formed on the underside of the frame 782.

The assembly 780 is generally similar, except as hereinafter described to the holddown and heel end centralising means of the shoe support described in U.S. 4,416,031, and full details of the assembly will therefore not be described in the present specification. The assembly 780 thus comprises a holddown 450' which in this case (unlike the holddown 450 of the aforementioned shoe support, which extends across the full width of the heel seat of the shoe and generally engages the lasting marginal portions of the shoe bottom) is so dimensioned as to provide a relatively narrow shoe-engaging portion which is engageable with the insole of the shoe, within the confines of the lasting marginal portions of the shoe upper in the heel seat region. As in the case of the holddown in the aforementioned shoe support, furthermore, the holddown 450' is movable into and out of an operative position in which it lies in opposed relationship with and above the last pin 722' and provides a height datum for the heel seat of a shoe which is placed upon the last pin and urged by the action of piston-and-cylinder arrangement 736 into engagement therewith. By engaging with the insole, furthermore, the heightwise position of the shoe at the heel end thereof can be more readily and reliably determined than is the case where the holddown engages with lasting marginal portions which, in the region of the heel seat, will be pleated and therefore of uneven depth, so that the heightwise postion of the heel end of the shoe cannot consistently be set with the accuracy necessary for a side wall roughing or similar operation. The movement of the holddown into and out of its operative position is effected by means of a piston-and-cylinder arrangement (not shown, but designated 460 in the aforementioned specification). Furthermore, the arrangement 736 constitutes means for bringing the heel seat of a shoe and the holddown 450 into engagement at the heel seat height datum. The heel end centralising means comprises first and second sets of clamps 390, 392 which respectively engage the heel end of a shoe in the region of the feather line and in the region of the top line thereof; again, details of these clamps are to be found in GB-A 2077090. The first set of clamps 390 are movable towards one another each through the same distance to engage the shoe in a region which is generally symmetrical about the toe- to-heel centre line of the shoe and thus effectively centralise the heel end of the shoe about the centre line of the shoe support. The second set of clamps 392 engage the shoe in a relatively asymmetrical region thereof and can move towards one another through different distances to accommodate to the asymmetry, serving primarily therefore as clamps to hold the shoe in position as determined by the first set of clamps 390. The two sets of clamps are each actuated by a piston-and- cylinder arrangement (not shown, but designated respectively 406 and 438 in the aforementioned specification).

The shoe support also comprises means for determining whether the shoe supported thereby is a left or a right, said means comprising a sensing device (not shown, but designated 610 in U.S. 4,416,031, which is of the inductance type and senses the position of the second set of clamps 392 in relation to a centre line of the support and thereby determines whether the shoe is a left or a right.

The assembly 780 further comprises a heel abutment 380' in the form of a plate against which the backseam region of a shoe placed on the last pin can be urged thus to determine the lengthwise position of the shoe in the shoe support 18. The plate 380' is resiliently urged toewardly through a short distance and has associated therewith a proximity switch (not shown) which is actuated when the plate 380' is caused to retract against the influence of the resilient means. Such actuation of the proximity switch causes a signal to be supplied to which reference will be made hereinafter.

For supporting the toe end portion of the shoe the shoe support 18' further comprises toe support means generally designated 470', which comprises a support casting 472 slidably mounted on two rods 356 extending lengthwise of the shoe support. For effecting such movement a piston-and-cylinder arrangement 510 is provided a piston rod of which is connected with the toe support means 470' and the cylinder of which is supported by a support portion forming part of the holddown and heel end centralising assembly 780. A further piston-and-cylinder arrangment 820 is provided for operating a bar lock arrangement (not shown) by which the toe support means 470' is held locked on the slide rods 356 after a shoe has been loaded and positioned in the shoe support.

The toe support means 470' comprises a toe support or toe pad 792 on which the toe end of a shoe supported by the last pin 722' can be supported, said toe pad being supported at the upper end of a column 793 itself carried by a piston rod of a piston-and-cylinder arrangement 794. The arrangement 794 is supported by a pin extending between a support plate 796 and a front plate 798 secured thereto by spacers 800. The support plate 796 is carried between, and extends heightwise of, the two blocks 472. For locking the toe pad in its heightwise adjusted position, a bar lock arrangement generally designated 802 is provided which is actuated by a piston-and-cylinder arrangement 804, itself also supported by a pin between the support plate and front plate.

The toe support means 470' also comprises a toe holddown or toe abutment 806 which is pivotally mounted on a support 808, itself mounted for pivotal movement, under the action of a piston-and-cylinder arrangement 810, on a block 812. The block 812 is itself supported by parallel links 814, whereby heightwise movement of the toe abutment 806 can be effected to move it from an operative position, in which it provides a height datum for the toe end of a shoe, to an out-of-the-way position, in which it will not interfere with the access by a roughing tool to side wall portions of the lasted shoe upper. For effecting such heightwise movement of the abutment a piston-and-cylinder arrangement 816 is provided a piston rod of which is connected to one of the links 814 by pivot pin 818. The piston-and-cylinder arrangement 816 is secured at its lower end on a lug on the support plate 796.

The toe support means 470' has associated therewith toe end centralising means (FIG. 5) comprising two upstanding centralising fingers 822' each of which is carried, for heightwise sliding movement, in a support block 880. Each block 880 is mounted on a pivot pin 826 and thus for pivotal movement about an axis extending lengthwise of the bottom of a shoe supported by the shoe support whereby the centralising fingers are movable towards and away from one another. The pivot pins 826 are inter-connected by a linkage generally designated 828 whereby to effect equal but opposite rotational movement of the pivot pins and thus equal but opposite pivotal movement of the centralising fingers. For effecting such movement, furthermore, a piston-and-cylinder arrangement 830 is provided a piston rod 832 of which is connected to said linkage, said arrangement being mounted on the front plate 798.

The centralising fingers 822' are each provided with a shoe-engaging element in the form of a flanged or collar portion 882, said portions serving to effect a shoe bottom levelling operation (as will be referred to hereinafter). To this end, the fingers 822' are each mounted for heightwise sliding movement in their respective blocks 880 and to this end each block is provided with a slot 884 through which projects a pin 886 carried by the finger 822'. Each pin 886 itself carries a trunnion block 888, the two trunnion blocks being captive each in one, bifurcated, end of a T-shaped member 890 itself mounted for heightwise sliding movement on the column 793. In this way, the fingers 822' are moved heightwise equidistantly in response to heightwise sliding movement of the member 890, the drive arrangement being such that such heightwise movement can be effected regardless of the position of the fingers 822' about the pins 826. For effecting heightwise movement of the member 890 a further piston-and-cylinder arrangement 892 is provided, which is secured to the plate 798 and the piston rod 894 of which is pivotally connected directly to a cross-portion of the T-shaped member 890.

In the operation of the machine in accordance with the invention the support 720 is initially in a lowered position and is urged by the balancing arrangement 760 in a direction towards the toe support 470' as described above. In addition under the action of piston-and-cylinder arrangement 736 the last pin 722', in its centralised position, is tilted in a direction away from the toe support. In this way the last pin is rendered more accessible for the last pin hole of the last and thus the loading of the shoe is facilitated. The operator then draws the shoe, together with the support 720, toewardly until the shoe abuts the toe abutment 806, causing it to pivot on its support 808. Such pivotal movement causes a rearwardly extending projection 834 on said abutment to be moved relative to a proximity switch 836 on the support 808, thereby signalling the presence of the toe end of the shoe. It will be realised that at this time the toe abutment is held in its raised position under the action of piston-and-cylinder 816 and the support is pivoted (anticlockwise viewing FIG. 3) to bring the toe abutment into its operative position in which it provides a heightwise datum for the toe end of the shoe; also at this time the toe pad 792 is in its retracted position. In response to the signal from the proximity switch 836 piston-and-cylinder arrangement 510 is actuated to move the blocks 472 along the rods 356 thus to move the shoe bodily together with the toe support means 470' towards the heel abutment 480'. Upon engagement of the heel end of the shoe with the heel abutment, the proximity switch associated with said abutment is actuated by the retraction of the heel abutment, thereby creating a further signal which terminates the operation of piston-and-cylinder arrangement 510 thus to bring the toe support means 470' to rest with the shoe now held by the various instrumentalities referred to. In addition piston-and-cylinder arrangement 820 is operated to cause the toe support means 470' to be locked in this position.

The shoe support also comprises a linear potentiometer 840 which is mounted at one end on the support portion of the holddown and heel end centralising assembly 780 which supports also the piston-and-cylinder arrangement 510, and the slide of which is connected to the toe support means 470'. In this way, the length of the shoe which is to be operated upon is measured, as a function of the amount of movement of the toe support means 470' towards the holddown and heel end centralising assembly 480.

Figure 4:
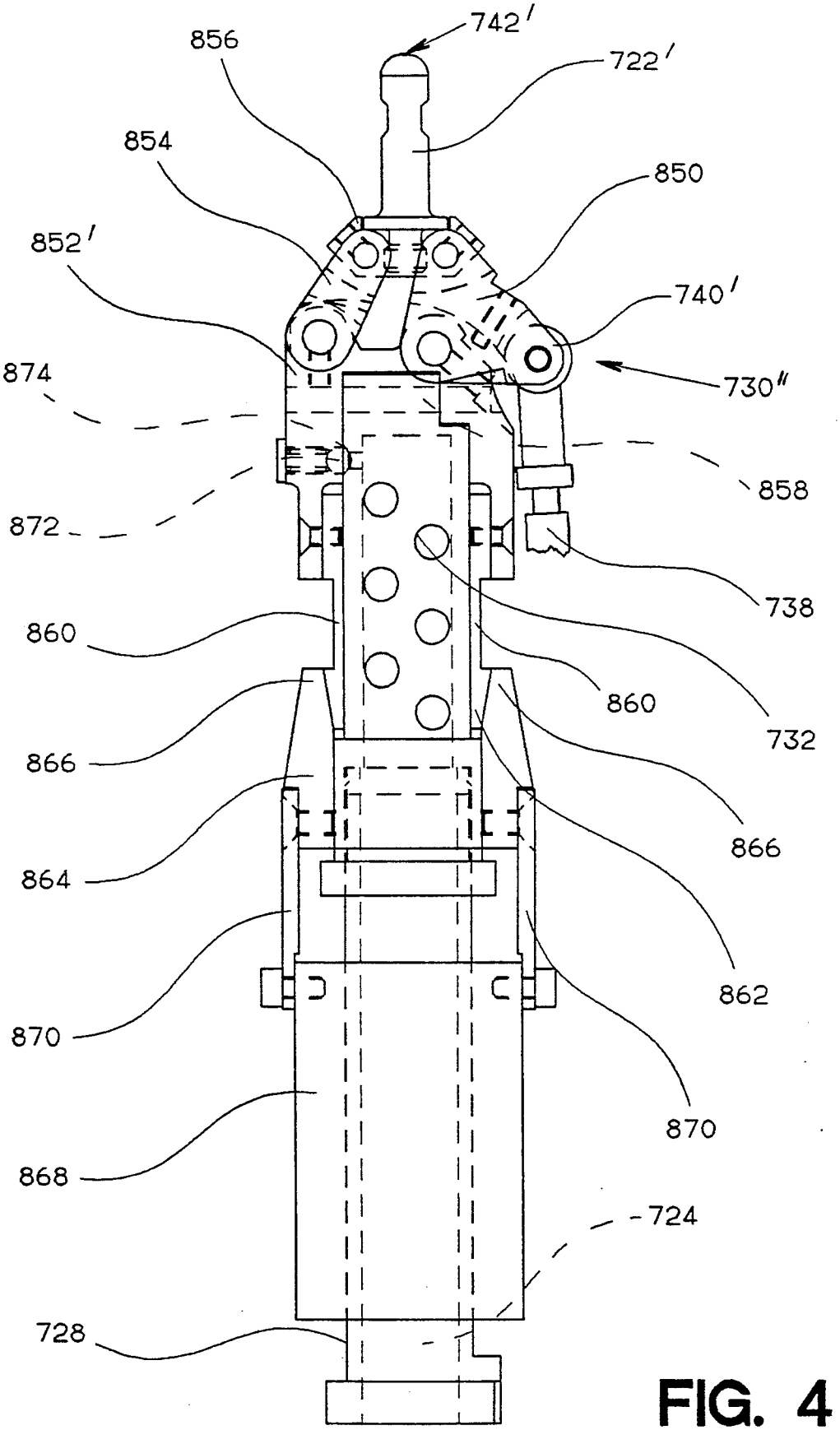
FIG. 4 is a fragmentary view showing details of a heel support of the shoe support of FIG. 3.
Figure 5:
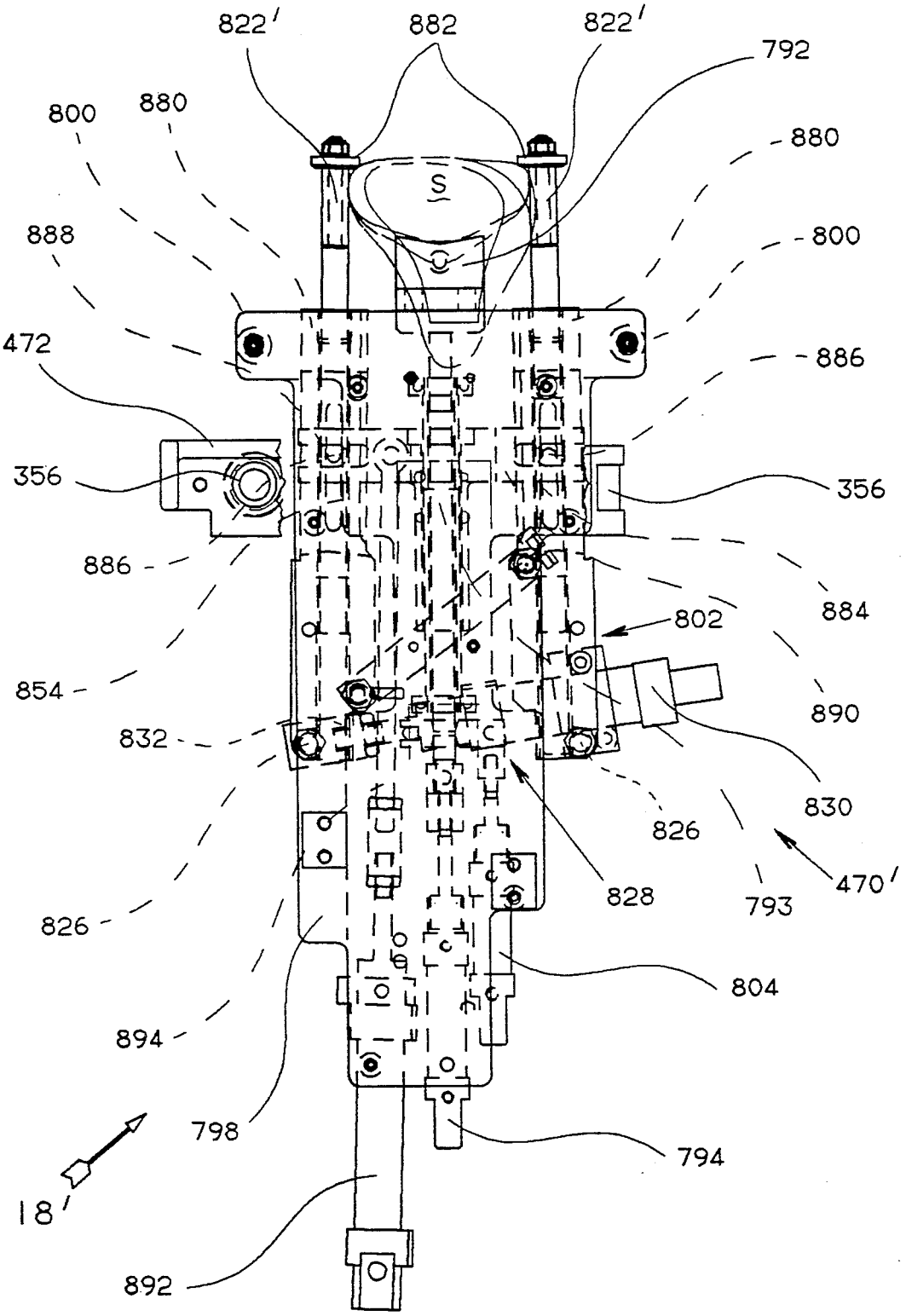
FIG. 5 is a fragmentary section view, on an enlarged scale, taken along the line V—V of FIG. 3.

When the machine is in its rest condition, the holddown 450', providing the height datum for the heel seat region of the shoe, is in its operative position and the last pin is retracted. When the signal is generated by the heel abutment, the last pin is raised under low pressure by the action of piston-and-cylinder arrangement 734 to bring the heel seat region of the shoe into engagement with the holddown 450' and also the toe pad 792 is raised under the action of piston-and-cylinder arrangement 794, to bring the toe end of the shoe into the correct heightwise position in relation to the toe abutment 806. The action of the piston-and-cylinder arrangement 734 in combination with the engagement of the toe end of the shoe with the toe abutment 806 caused the last pin 722' to be moved to a vertical, or substantially vertical, position (generally as shown in FIGS. 4 and 5). At the same time, the heel clamp arrangements 390, 392 and also the centralising fingers 822' are operated whereby to centralise both the heel end of the shoe and the toe end thereof along the centre line of the shoe support, the clamps 390 also serving to determine whether the shoe is a left or a right. With the shoe thus held, the centralising fingers 822', which at this stage are in a raised condition, are then lowered to bring the collar portions 882 thereof into engagement with the lasting marginal portions of the shoe support in the forepart region of the shoe bottom, the effect of such engagement being to ensure that the shoe bottom is levelled, about the heel-to-toe centre line as determined by the toe abutment 806 and holddown 450'. During this levelling movement, furthermore, the last pin may be rocked about the axis of the pivot pin 858, which extends lengthwise of the shoe bottom.

The heightwise position of both the last pin and the toe pad and also the widthwise and "rock" position of the last pin are thus established according to the size, style and "hand" of the shoe and thereupon the locking arrangement for the last pin support 720 and also the bar lock arrangement 802 are operated upon actuation respectively of piston-and-cylinder arrangements 754 and 804. In addition, piston-and-cylinder arrangement 868 is actuated thus to lock the last pin in its "rock" position and thereby to secure the shoe in its levelled condition. Thereafter, the piston-and-cylinder arrangement 736 is subjected to high pressure whereby the last pin 722' is caused to be urged to pivot about the axis 742' relative to its support 720 toewardly in order to ensure that the last pin binds on the last pin hole, thereby securing the lasted shoe between the last pin and the toe pad. (It will thus be appreciated that piston-and-cylinder arrangement 736 has the dual function of raising the last pin and also urging it to pivot; by reason of these separate functions this arrangement constitutes in the preferred embodiment both first and third motor means of the shoe support.)

At this stage the lasted shoe is thus corrected clamped in the shoe support 18' and is ready for the initiation of a side wall roughing operation. Upon such initiation firstly the centralising fingers 822' are moved upwardly and outwardly by the actuation respectively of piston-and-cylinder arrangements 892 and 830. The roughing tool is then brought from its rest, retracted, position to an operative position in which it engages the side wall portion of the shoe in the region of the breast line of the inside waist thereof; at this stage the shoe is still held not only by the last pin and toe pad as aforesaid, but also by the toe abutment 806 and the clamps 390, 392 and holddown 450. As the tool approaches the toe end of the shoe, a signal is generated to cause the toe abutment 806 to be pivoted under the action of piston-and-cylinder arrangement 810 and also to be retracted under the action of piston-and-cylinder arrangement 816 acting through the parallel linkage 814. A proximity switch 838 is provided whereby in response to such retraction a signal is generated indicating that such retraction has taken place; in the event of no such signal being generated, the advancing movement of the tool towards the toe end of the shoe will be arrested. After the passage of the tool round the toe end of the shoe, the toe abutment is returned to its operative position. In this return movement, furthermore, the proximity switch 838 ensures that the heightwise movement under the action of piston-and-cylinder arrangement 826 takes place before the swinging movement of the support 808 under the action of piston-and-cylinder arrangement 810. In this way it is ensured that no collision can take place between the toe abutment 806 and the toe end of the shoe.

Similarly, as the tool approaches the heel end of the shoe, the clamps 390, 392 are caused to release the heel end of the shoe, the holddown is retracted out of its operative position and the assembly 780 is then moved bodily about the axis 784 to an out-of-the-way position under the action of piston-and-cylinder arrangements 786. The tool can then progressively operate around the heel end of the shoe and back to its starting position at the breast line of the shoe, whereafter the tool is moved out of operative engagement with the shoe and returns to its initial position.

The shoe support then returns to its loading/ unloading position and the toe support means 470' is moved in a direction away from the heel abutment under the action of piston-and-cylinder arrangement 510 thus to release the shoe.

It will be appreciated that, in order to be able reliably to operate on shoes of opposite "hand", it is necessary that the collar portions 882 of the centralising fingers are correctly set in relation to each other. Moreover, in order to ensure that an accurate and reliable operation is performed on a shoe, especially in the case of the roughing of side wall portions of a shoe, is effective, desirably the collar portions 882 are also each set in a correct relationship with the height datum point P of the machine. To this end, a fixture (not shown) may be provided by which not only the height datum of the machine is set, and thus the datum for the tool supported by the tool supporting means 26' is provided, but also such fixture provides for the height setting of the collar portions 882, both in relation to each other and also to the height datum of the machine. Such an arrangement is especially useful where the control of the machine is electronic and the tool can be "zeroed" at the datum position P.

We claim:

1. A shoe support for supporting a lasted shoe comprising a last pin and a toe support by which respectively the heel and toe ends of a lasted shoe can be supported, the last pin being mounted on a last pin support for limited tilting movement about an axis extending lengthwise of a shoe supported as aforesaid, two shoe-engaging members arranged, in a fixed heightwise relationship with one another, one at each side of the lasted shoe supported by the toe support and last pin so as to be engageable with the lasting margin of such shoe in the forepart region thereof, and means for effecting relative movement of approach, heightwise of the shoe bottom, between the toe support and the shoe-engaging members whereby a lasted shoe supported as aforesaid can be positioned with the lasting margins at opposite sides thereof at a heightwise location determined by the shoe-engaging members.

2. A shoe support according to claim 1 also comprising a heel seat abutment which is dimentioned so as to be engageable with the insole of a shoe supported as aforesaid in the heel seat region thereof, and means for effecting relative movement of approach, heightwise of the shoe bottom, between said abutment and the last pin whereby the heel seat of such shoe is brought to a heel seat height datum.

3. A shoe support according to claim 2 further comprising a toe abutment which is engageable with the lasting margin of the toe end of a lasted shoe supported as aforesaid at the toe region thereof, and means for effecting relative movement of approach, heightwise of the shoe bottom, between the toe abutment and the toe support whereby the toe end of such shoe is brought to a toe height datum.

4. A shoe support according to claim 3 wherein relative heightwise movement of approach is effected between the two shoe-engaging members and the toe support only after each of the heel seat and toe ends of the shoe has been brought to its height datum as aforesaid.

5. A shoe support according to claim 4 wherein the heel seat abutment is movable into and out of an operative position in which it is disposed in opposed relationship with the last pin, the means for effecting relative movement of approach between the heel seat abutment and the last pin being effective to move the last pin towards said abutment, the toe abutment is movable into and out of an operative position in which it can co-operate with the toe support and the means for effecting relative movement of approach between the toe support and the toe abutment is effective to move the toe support towards the toe abutment, and the means for effecting relative movement between the toe support and the two shoe-engaging members is effective to move said members towards the toe support.

6. A shoe support according to claim 1 further comprising toe centralising means engageable with opposite sides of a shoe supported as aforesaid in the forepart region thereof, said means including two centralising elements arranged one at either side of such shoe and movable equidistantly but in contrary directions transversely of the shoe bottom, wherein each centralising element supports one of said two shoe-engaging members.

7. A shoe support according to claim 6 also comprising a heel seat abutment which is dimentioned so as to be engageable with the insole of a shoe supported as aforesaid in the heel seat region thereof, and means for effecting relative movement of approach, heightwise of the shoe bottom, between said abutment and the last pin whereby the heel seat of such shoe is brought to a heel seat height datum.

8. A shoe support according to claim 7 further comprising a toe abutment which is engageable with the lasting margin of the toe end of a lasted shoe supported as aforesaid at the toe region thereof, and means for effecting relative movement of approach, heightwise of the shoe bottom, between the toe abutment and the toe support whereby the toe end of such shoe is brought to a toe height datum.

9. A shoe support according to claim 8 wherein relative heightwise movement of approach is effected between the two shoe-engaging members and the toe support only after each of the heel seat and toe ends of the shoe has been brought to its height datum as aforesaid.

10. A shoe support according to claim 9 wherein the heel seat abutment is movable into and out of an operative position in which it is disposed in opposed relationship with the last pin, the means for effecting relative movement of approach between the heel seat abutment and the last pin being effective to move the last pin towards said abutment, the toe abutment is movable into and out of an operative position in which it can co-operate with the toe support and the means for effecting relative movement of approach between the toe support and the toe abutment is effective to move the toe support towards the toe abutment, and the means for effecting relative movement between the toe support and the two shoe-engaging members is effective to move said members towards the toe support.

11. A shoe support according to claim 6 also comprising locking means for locking the last pin against tilting movement after the shoe has been positioned as determined by the two shoe-engaging members, said locking means comprising a first wedge element fixedly connected with the last pin and a second, complementary, wedge element slidably mounted on the last pin support, the arrangement being such that after the positioning of the shoe as aforesaid the second wedge element is caused to slide on the last pin support and thus to engage and lock the first wedge element and the last pin therewith.

12. A shoe support according to claim 11 wherein the first wedge element is constituted by a segment of a disc having a chamfered edge whereby with the centre of the disc located at the tilt axis of the last pin the portion of the edge presented for co-operation with the second wedge element has the same shape regardless of the position to which the last pin has been tilted.

13. A shoe support according to claim 1 also comprising locking means for locking the last pin against tilting movement after the shoe has been positioned as determined by the two shoe-engaging members, said locking means comprising a first wedge element fixedly connected with the last pin and a second, complementary, wedge element slidably mounted on the last pin support, the arrangement being such that after the positioning of the shoe as aforesaid the second wedge element is caused to slide on the last pin support and thus to engage and lock the first wedge element and the last pin therewith.

14. A shoe support according to claim 11 wherein the first wedge element is constituted by a segment of a disc having a chamfered edge whereby with the centre of the disc located at the tilt axis of the last pin the portion of the edge presented for co-operation with the second wedge element has the same shape regardless of the position to which the last pin has been tilted.

* * * * *